US005345997A

United States Patent [19]

Drössler et al.

[11] Patent Number: 5,345,997

[45] Date of Patent: Sep. 13, 1994

[54] COOLING DEVICE

[75] Inventors: Eckart Drössler, Thüringen, Austria; Rainer Batliner, Schaanwald, Liechtenstein

[73] Assignee: Hilti Aktiengesellschaft, Furstentum, Liechtenstein

[21] Appl. No.: 170,647

[22] Filed: Dec. 17, 1993

Related U.S. Application Data

[63] Continuation of Ser. No. 883,847, May 15, 1992, abandoned.

[30] Foreign Application Priority Data

May 17, 1991 [DE] Fed. Rep. of Germany ..... 4116216

[51] Int. Cl.[5] ..... F27D 15/00; C21D 1/62

[52] U.S. Cl. ..... 165/47; 34/171; 34/178; 266/130; 165/920

[58] Field of Search ..... 266/260, 261, 130; 165/47, 920; 34/171, 178, 172, 231

[56] References Cited

U.S. PATENT DOCUMENTS

| | | | |
|---|---|---|---|
| 137,459 | 4/1873 | Mackey | 34/178 |
| 159,014 | 1/1875 | Beach | 34/178 |
| 217,053 | 7/1879 | Brooke | 34/178 |
| 408,660 | 8/1889 | Herr | 34/171 |
| 945,089 | 1/1910 | Hagmann | 34/178 |
| 1,414,180 | 4/1922 | Collins | 34/178 |
| 1,424,904 | 8/1922 | Heindl | 34/178 |
| 1,816,236 | 7/1931 | Shuyler | 34/171 |
| 2,074,029 | 3/1937 | Schulman | 34/171 |
| 2,317,003 | 4/1943 | Vissac | 34/172 |
| 2,494,361 | 1/1950 | Scarbrough et al. | 266/259 |
| 3,423,840 | 1/1969 | Beeken | 34/178 |
| 3,841,836 | 10/1974 | Lunsford, Jr. et al. | 34/171 |
| 4,515,629 | 5/1985 | Dizek et al. | 34/178 |

FOREIGN PATENT DOCUMENTS

| | | | |
|---|---|---|---|
| 1501461 | 4/1969 | Fed. Rep. of Germany | 165/920 |
| 2337698 | 2/1974 | Fed. Rep. of Germany . | |
| 921593 | 3/1963 | United Kingdom | 34/171 |
| 1184271 | 3/1970 | United Kingdom | 266/130 |
| 1344513 | 1/1974 | United Kingdom | 34/178 |

*Primary Examiner*—John K. Ford

*Attorney, Agent, or Firm*—Anderson Kill Olick & Oshinsky

[57] ABSTRACT

A cooling device (1) in the form of a vertically arranged hollow chamber is located between a heat treatment furnace (9) and a quenching bath (11*d*). The device controls the cooling of small hardware items dropping downwardly through it from the furnace (9) to the bath (11*d*). Spaced baffles (3) are arranged in the hollow chamber and are adjustably inclinable relative to the vertical. A heat transfer member is connected to the baffles so that heat can be removed from or stabilized in the small hardware items flowing over the baffles.

6 Claims, 2 Drawing Sheets

COOLING DEVICE

This is a continuation of patent application Ser. No. 07/883,847, filed May 15, 1992, now abandoned.

BACKGROUND OF THE INVENTION

The present invention is directed to a device for cooling small hardware items and is located between a heat treating furnace and a quenching bath.

The requirements dealing with properties of heat treated parts are significant and increase continuously. The specified properties must be achieved as uniformly as possible in each individual part as well as within the entire charge of parts. Therefore, the heat treatment devices must fulfill the highest types of requirements.

Steel is heated to such a high temperature for heat treatment purposes that pearlite is transformed with certainty into austenite. The cubic body centered crystalline lattice of the ferrite changes over into the cubic plane centered crystalline lattice of the austenite. The resultant texture is designated as austenite. It is soft, tough as well as non-magnetic and forms grains with pointed corners.

Upon slow cooling, the texture is transformed back into its initial state.

To obtain a hardening or heat treatment of the part, cooling must occur very rapidly. The fine needle texture which is formed is very hard. It is called martensite.

A fluidized bed can be used as a quenching bath for hardening small hardware items, and in addition, a surface coating of the items can be effected. The hot items, such as small hardware items, for instance, bolts or nails, coming from the heat treatment station are directed to a fluidized bed where a fluidized powder is located. The heat content of the small hardware items entering the fluidized bed is determined by the thickness of the coating to be melted or fused onto the items.

SUMMARY OF THE INVENTION

The primary object of the present invention is to provide a device for controlling the temperature of the small hardware items falling into the fluidized bed and thus determining the thickness of the coating on the items.

In accordance with the present invention, the cooling device includes a vertically arranged hollow chamber open at its upper and lower ends and containing plates or baffles located one below the other and offset with respect to one another in an inclined manner relative to the vertical, so that a tortuous flow path is provided through the hollow chamber. The angle of inclination of the baffles with respect to the vertical or walls of the hollow chamber is adjustable and, in addition, the baffles are able to conduct heat.

Accordingly, the hot small hardware items, such as bolts or nails, flowing from the heat treating furnace and contacting the plates or baffles can be cooled or their temperature can be stabilized before reaching the quenching bath in the form of a fluidized bed. The cooling or temperature stabilization can be determined by the number of baffles or plates to be contacted and by the rate of fall of the small hardware items passing downwardly through the hollow chamber. The downward velocity is controlled by the adjustability of the angle of inclination of the baffles.

Depending upon the adjusted inclination of the baffles, there are different spacings between the baffles and the hollow chamber walls. To prevent the small hardware items from bypassing the flow path afforded by the baffles or becoming stuck in the flow path, spring plates are fastened to walls of the chamber and adjust to the inclination of the baffles and form an appropriate transition.

Preferably, the baffles include a member for thermal regulation. As a result, the temperature of the baffles and the temperature inside the hollow chamber are controllable.

The heat control member is preferably in the form of a pipe for flowing a heat transfer medium. Accordingly, an economical connection of the heat control member with the baffles can be achieved.

The cooling and the corresponding heat content of the small hardware items can be defined by the parameters: "drop time of the parts through the hollow chamber" and the "temperature of the baffles".

In an advantageous arrangement, the heat control member is located on the opposite side of the baffles from the side contacting the small hardware items. As the small hardware items pass downwardly through the hollow chamber, they impact against the individual baffles or roll over the baffle surfaces. As a result, the baffle surfaces experience very high wear. Accordingly, the baffles are either heat treated or hardened in this region or are covered by a hard material. The heat member for effecting heat control is thus arranged on the side of the baffles opposite the side in contact with the small hardware items. Therefore, contact and possible damage to the heat control member by the small hardware items is prevented.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive manner in which there are illustrated and described preferred embodiments of the invention.

DETAILED DESCRIPTION OF THE INVENTION

Figure 1:
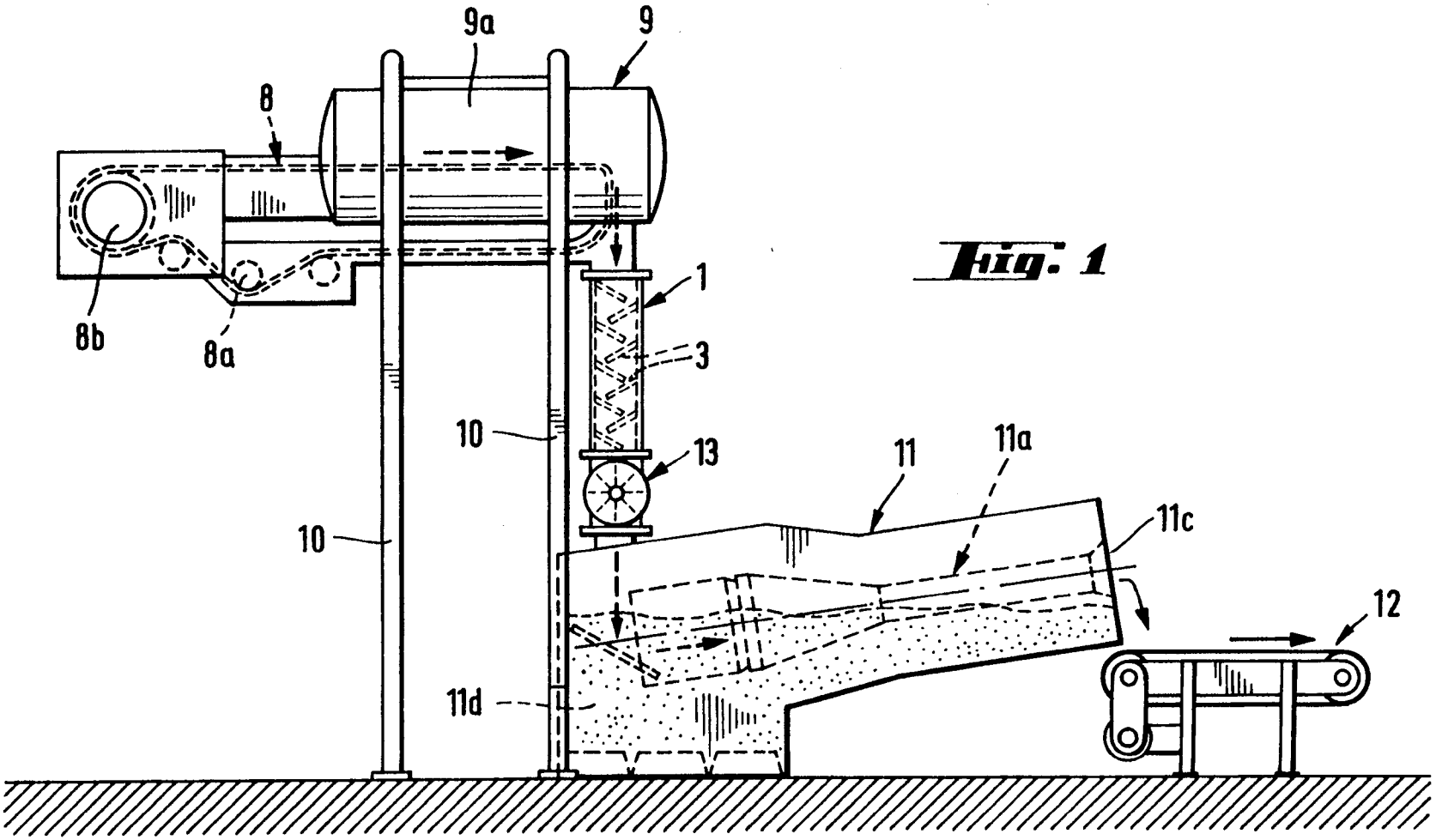
FIG. 1 is a diagrammatic elevational view of an entire installation including a heat treatment furnace and a quenching bath in the form of a fluidized bed.

FIG. 1 shows an installation where small hardware items are heat treated and subsequently coated. The installation is arranged essentially in a step-like manner. A heat treatment furnace 9 is supported in an elevated position by a structural stand 10. A conveyor belt 8, such as a known multi-link chain belt, conveys the small hardware items through the furnace 9. The multi-link chain is tightened by means of tightening rollers 8*a*. The small hardware items exiting from the heat treatment furnace 9 have a very high temperature as they drop into a cooling device 1 in the form of a vertically arranged hollow chamber. From the bottom of the cooling device 1 the small hardware items enter a bucket wheel lock 13 forming a seal between the quenching bath 11*d* connected to the lower end of the cooling device and heat treatment furnace. Volatile elements of the quenching bath 11*d* located in a retort 11 could otherwise flow upwardly into the heat treatment furnace and cause it damage.

Within the retort 11, powder is transformed into a fluidized state by means of a gas introduced into the retort, so that the combination of the gas and the powder form a fluidized bed serving as the quenching bath 11*d*. The small hardware items having passed through the heat treatment furnace 9 and dropped downwardly through the cooling device 1 are coated with a thin layer in the fluidized bed. The small hardware items are conveyed within the fluidized bed through a drum 11*a* inclined upwardly from its inlet to its outlet. Inside the drum there is a conveying helix for the small hardware items, however, the helix is not illustrated. After passing through the retort 11, the small hardware items pass through the outlet 11*c* and drop onto a conveyor belt 12 which carries the items away.

Figure 2:
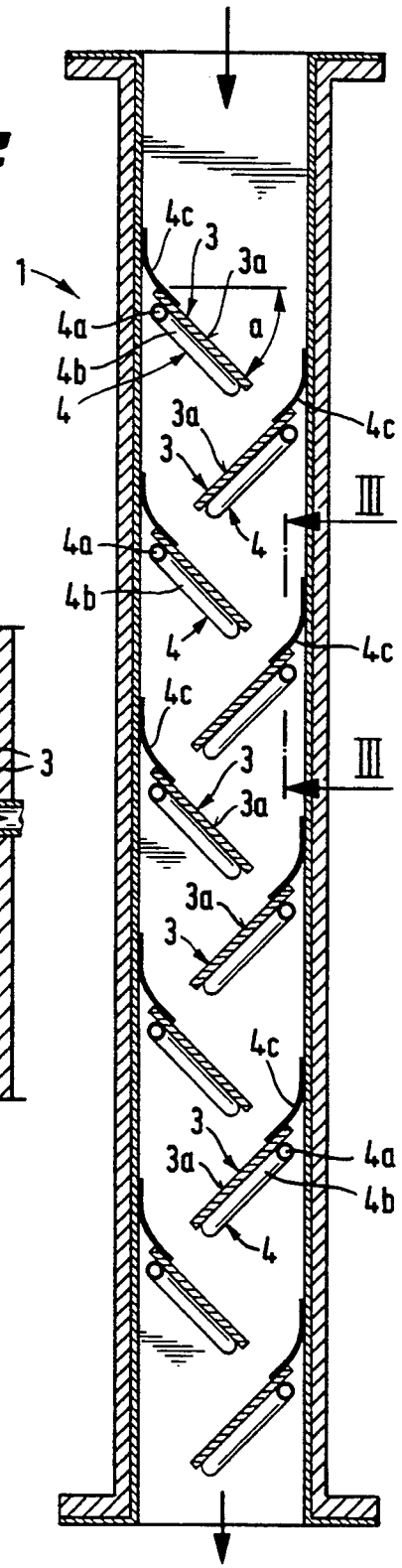
FIG. 2 is an enlarged elevational view of a cooling device in the form of a hollow chamber, as shown in FIG. 1.

FIG. 2 shows the vertically arranged cooling device 1 in the form of a hollow chamber and displayed on an enlarged scale as compared to FIG. 1. A number of baffles 3 are located within the hollow chamber each inclined to the vertical and spaced one below the other forming a tortuous flow path for the small hardware items flowing downwardly through the hollow chamber. Each baffle has a upper surface 3*a* for contacting the hardware items and an opposite lower surface out of contact with the items. A cooling member 4 for temperature regulation is in the form of a pipe 4*b* through which a heat exchange medium 4*a* can flow. The pipes are arranged on the opposite surface from the surface 3*a* so that they cannot be damaged by the small hardware items flowing downwardly over the baffles 3.

The time for the passage of the small hardware items through the cooling device 1 can be determined by the adjustable inclination or slope of the baffles 3. Depending upon the inclination angle a of the baffles 3 different openings or spaces between the edges of the baffles and the walls of the hollow chamber are formed. To assure that the small hardware items do not bypass the baffles or become stuck in the downward flow path, spring plates 4*c* are fastened to the walls of the hollow chamber and to the upper ends of the baffles and the spring plates adjust to the adjusted slope or inclination angle a of the baffles, whereby the small hardware items follow the desired flow path downwardly through the hollow chamber flowing over the surfaces 3*a* of the baffles 3. As shown, preferably ten baffles 3 are positioned in the hollow chamber of the cooling device 1. The number of the baffles used is adapted to the particular conditions in the installation.

Figure 3:
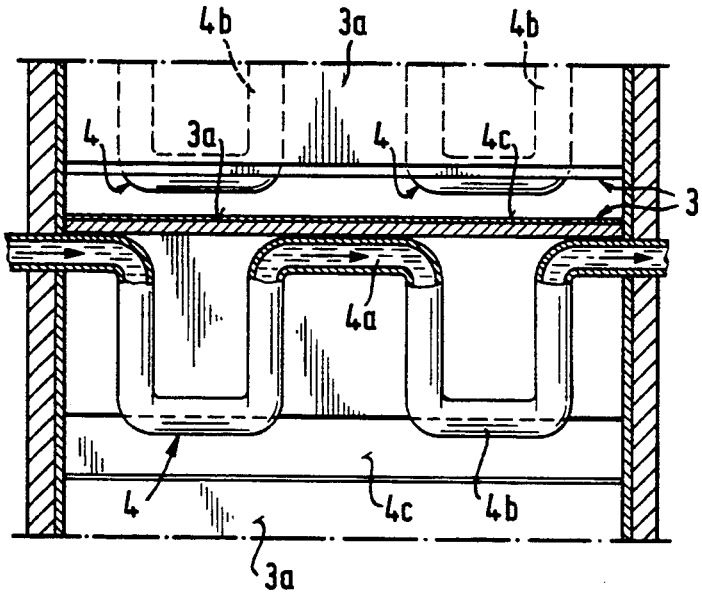
FIG. 3 is a sectional view taken along the line III—III in FIG. 2 and shown on an enlarged scale.

FIG. 3 is a partial sectional view illustrating the member 4 used for temperature regulation within the hollow chamber. The member 4 is made up of pipes 4*b* fixed to the rear side of the baffles, that is, the opposite side from the contact surfaces 3*a*, and the pipes follow a sinuous path. The pipes 4*b* can be connected to the baffles 3 in a heat conducting manner, such as by soldering, bonding, bolting, riveting or welding. The heat transfer medium 4*a* flowing through the pipes 4*b* has its temperature stabilized by a heat exchanger, not shown, and by its flow velocity. The temperature regulation can be provided by other heat exchange members fabricated by casting, pressing, deep-drawing, welding, bolting or bonding.

While specific embodiments of the invention have been shown and described in detail to illustrate the application of the inventive principles, it will be understood that the invention may be embodied otherwise without departing from such principles.

We claim:

1. Device for cooling small hardware items positioned between a heat treatment furnace (9) and a quenching bath (11*d*), the device comprises wall means forming a generally vertically arranged hollow chamber having an upper inlet end and a lower outlet end, a plurality of baffles (3) spaced apart in the vertical direction within the hollow chamber, adjacent said baffles are offset relative to one another and inclined relative to the vertical for forming a tortuous downward flow path between the inlet and the outlet, said baffles each have an adjustable angle of inclination, relative to the vertical, wherein the improvement comprises that said baffles are thermal conductors, said wall means comprises opposed walls, a separate adjustable spring plate connects an upper end of each said baffle to an adjacent said wall of said hollow chamber, said spring plates are adjustable to the adjustable angle of inclination of said baffles and prevent the small hardware items flowing downwardly over said baffles from bypassing the downward flow path by moving between said baffles and the adjacent said walls.

2. Device as set forth in claim 1, wherein a heat transfer member (4) is connected to the baffles (3) for effecting thermal regulation.

3. Device, as set forth in claim 2, wherein the heat transfer member (4) is formed as a pipe for flowing a heat transfer medium (4*a*) therethrough.

4. Device, as set forth in claim 2, wherein each of said baffles has a first surface arranged to contact the small hardware items flowing downwardly through the hollow chamber and an opposite second surface out of contact with the small hardware items, and the heat transfer member is located on the second surface of the baffles and is connected thereto in a heat conducting manner.

5. Device, as set forth in claim 3, wherein each of said baffles has a first surface arranged to contact the small hardware items flowing downwardly through the hollow chamber and an opposite second surface out of contact with the small hardware items, and the heat transfer member is located on the second surface of the baffles and is connected thereto in a heat conducting manner.

6. Device, as set forth in claim 5, wherein said pipe is shaped to provide a sinuous flow path therethrough for the heat transfer medium.

* * * * *